US011280182B2

(12) United States Patent
Dwars et al.

(10) Patent No.: US 11,280,182 B2
(45) Date of Patent: Mar. 22, 2022

(54) ROTARY STEERABLE DRILLING SYSTEM, A DRILL STRING SUB THEREFOR AND A METHOD OF OPERATING SUCH SYSTEM

(71) Applicant: SHELL OIL COMPANY, Houston, TX (US)

(72) Inventors: Sicco Dwars, Houston, TX (US); Paul Anthony Donegan McClure, Aberdeen (GB); Sergey Sotskiy, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/754,518

(22) PCT Filed: Oct. 9, 2018

(86) PCT No.: PCT/EP2018/077460
§ 371 (c)(1),
(2) Date: Apr. 8, 2020

(87) PCT Pub. No.: WO2019/072836
PCT Pub. Date: Apr. 18, 2019

(65) Prior Publication Data

US 2020/0392839 A1 Dec. 17, 2020

(30) Foreign Application Priority Data

Oct. 12, 2017 (EP) ..... 17196135
Nov. 8, 2017 (EP) ..... 17200618

(51) Int. Cl.
*E21B 7/06* (2006.01)
*E21B 47/14* (2006.01)
*E21B 21/12* (2006.01)

(52) U.S. Cl.
CPC ..... *E21B 47/14* (2013.01); *E21B 7/06* (2013.01); *E21B 7/065* (2013.01); *E21B 21/12* (2013.01)

(58) Field of Classification Search
CPC . E21B 47/14; E21B 7/06; E21B 21/12; E21B 44/00
See application file for complete search history.

(56) References Cited

U.S. PATENT DOCUMENTS 4,637,479 A * 1/1987 Leising ..... E21B 7/18 175/26
5,803,185 A * 9/1998 Barr ..... E21B 7/06 175/45

(Continued)

FOREIGN PATENT DOCUMENTS

WO 2019002436 A1 1/2019

OTHER PUBLICATIONS

International Search Report and Written Opinion received for PCT Patent Application No. PCT/EP2018/077460, dated Dec. 19, 2018, 10 pages.

(Continued)

*Primary Examiner* — Giovanna Wright
(74) *Attorney, Agent, or Firm* — Shell Oil Company

(57) ABSTRACT

A drill string sub for a rotary steerable drilling system wherein a flow diverter is configured, which flow diverter is configured rotatable about a drill string longitudinal axis at a relative rotation frequency relative to the drill string sub, to preferentially direct drilling fluid into a selected azimuth segment which is stationary relative to the flow diverter. A downhole data unit is configured to provide an information signal representing downhole data. An encoder operatively connected to the flow diverter to modulate the relative rotation in accordance with the information signal for trans- (Continued)

mitting information representing the downhole data to be detected uphole.

11 Claims, 2 Drawing Sheets

(56) References Cited

U.S. PATENT DOCUMENTS

| | | | | |
|---|---|---|---|---|
| 5,931,239 | A * | 8/1999 | Schuh | E21B 7/062 175/61 |
| 2002/0157867 | A1 * | 10/2002 | Moore | E21B 49/06 175/20 |
| 2016/0061019 | A1 | 3/2016 | Blange et al. | |
| 2016/0076305 | A1 | 3/2016 | Blange et al. | |
| 2016/0084011 | A1 | 3/2016 | Blange et al. | |
| 2016/0160567 | A1 | 6/2016 | Downton | |
| 2017/0211370 | A1 | 7/2017 | Blange | |

OTHER PUBLICATIONS

De Almeida Jr. et al., "A Review of Telemetry Data Transmission in Unconventional Petroleum Environments Focused on Information Density and Reliability", Journal of Software Engineering and Applications, vol. 8, pp. 455-462.

* cited by examiner

ROTARY STEERABLE DRILLING SYSTEM, A DRILL STRING SUB THEREFOR AND A METHOD OF OPERATING SUCH SYSTEM

CROSS REFERENCE TO RELATED APPLICATIONS

This is a National stage application of International Application No. PCT/EP2018/077460, filed 9 Oct. 2018, which is incorporated herein by reference in its entirety, and which claims benefit of priority of European application Nos. 17200618.1 filed 8 Nov. 2017 and 17196135.2, filed 12 Oct. 2017.

FIELD OF THE INVENTION

In one aspect, the present invention relates to a drill string sub for a rotary steerable drilling system. In another aspect, the present invention relates a rotary steerable drilling system comprising such drill string sub. In still another aspect, the present invention relates to a method of operating such a rotary steerable drilling system.

BACKGROUND OF THE INVENTION

Drill string equipment enabling directional drilling in earth formations generally include a bottomhole assembly (BHA) configuration which includes a steering device to impart a lateral force to the drill bit; instruments to measure the path of the borehole in three-dimensional space; and data links to communicate measurements taken downhole to the surface. Mud motors and other special BHA components and drill bits may be additionally provided in some cases.

US patent application publication US 2016/0061019 A1 describes systems and methods that accomplish deviated drilling by diverting circulating drilling fluid in a geostationary manner within the drill string, to selectively provide more drilling fluid to drilling fluid nozzles at a selected azimuthal segment around a predetermined geostationary azimuth compared to other drilling fluid nozzles that are not in said selected azimuthal segment.

In such systems and methods, a drill string rotates in an azimuthal direction about a drill string longitudinal axis. A drill bit is connected to a lower end of the drill string in a rotation-locked configuration to rotate in unison with the drill string about the drill string longitudinal axis. Drilling fluid is circulated from an upper end of the drill string to the lower end of the drill string via a drilling fluid passage within the drill string, whereby a flow diverter is configured in a lower end of the drill string in the drilling fluid passage, which flow diverter is configured rotatable about the drill string longitudinal axis relative to the drill string. An internal drive system is provided to drive the rotation of the flow diverter relative to the drill string.

The flow diverter can direct the drilling fluid from the drilling fluid passage into an azimuth segment which is stationary relative to the flow diverter. As a result, the drilling fluid is expelled more through the nozzle(s) that by rotation of the drill string and drill bit move through the azimuth segment than through nozzles that are on an opposing side. This creates an underpressure resulting in a curve in the trajectory of the borehole being drilled. For drilling in a straight direction, the flow diverter can be allowed to rotate relative to the surrounding formation, and thus flush each side of the borehole.

Above the flow diverter and the internal drive system, the tool of US 2016/0061019 A1 is provided with a measurement-while-drilling (MWD) device which makes measurements downhole and transmits data to the surface or to other sections of the directional drilling tool. Data transmission typically involves digitally encoding data and transmitting to the surface as pressure pulses in the mud system.

SUMMARY OF THE INVENTION

The invention provides a drill string sub for a rotary steerable drilling system, said drill string sub comprising a drill string end connectable to a drill string, and a drill bit end opposing the drill string end in a longitudinal direction, and said drill string sub being rotatable in an azimuthal direction about a drill string longitudinal axis, comprising:

- a drilling fluid passage within the drill string sub, to support a flow of drilling fluid from the drill string end to the drill bit end via the drilling fluid passage;
- a flow diverter configured within in the drilling fluid passage, which flow diverter is configured rotatable about the drill string longitudinal axis at a relative rotation frequency relative to the drill string sub, to preferentially direct the drilling fluid from the drilling fluid passage into a selected azimuth segment which is stationary relative to the flow diverter;
- a plurality of flow channels which are rotationally locked to the drill string sub and intermittently align with the eccentric flow port of the flow diverter upon rotation of flow diverter relative to the flow channels;
- a downhole data unit configured to provide an information signal representing downhole data;
- an encoder operatively connected to the flow diverter to modulate the relative rotation in accordance with the information signal for transmitting information representing the downhole data to be detected uphole.

In another aspect, the invention provides a rotary steerable drilling system comprising:

- a drill string extending from above the Earth's surface into a borehole below the Earth's surface whereby a lower end of the drill string is surrounded by an Earth formation;
- a drill string sub as defined above connected to the lower end of said drill string;
- a rotary drive arranged above the Earth's surface and engaging with an upper end of said drill string to impart rotation to the drill string about the longitudinal axis.

In still another aspect, the invention provides a method of operating a drill string sub comprised in such rotary steerable drilling system. The method comprises:

- rotating the drill string sub in a drill string rotation direction about its longitudinal axis, within an Earth formation, and at a drill string rotation frequency, wherein alternatingly:
- rotating the flow diverter in a geostationary mode, wherein keeping the flow diverter in a geostationary orientation whereby the flow diverter rotates at a relative rotation frequency, relative to the flow channels, which is oppositely directed to the drill string rotation direction and equal to the drill string rotation frequency; and
- rotating the flow diverter in an encoding mode whereby modulating the relative rotation in accordance with an information signal with the purpose of transmitting information representing the downhole data to be detected uphole.

BRIEF DESCRIPTION OF THE DRAWING

The appended drawing, which is non-limiting, comprises the following figures.

DETAILED DESCRIPTION OF THE INVENTION

Figure 1:
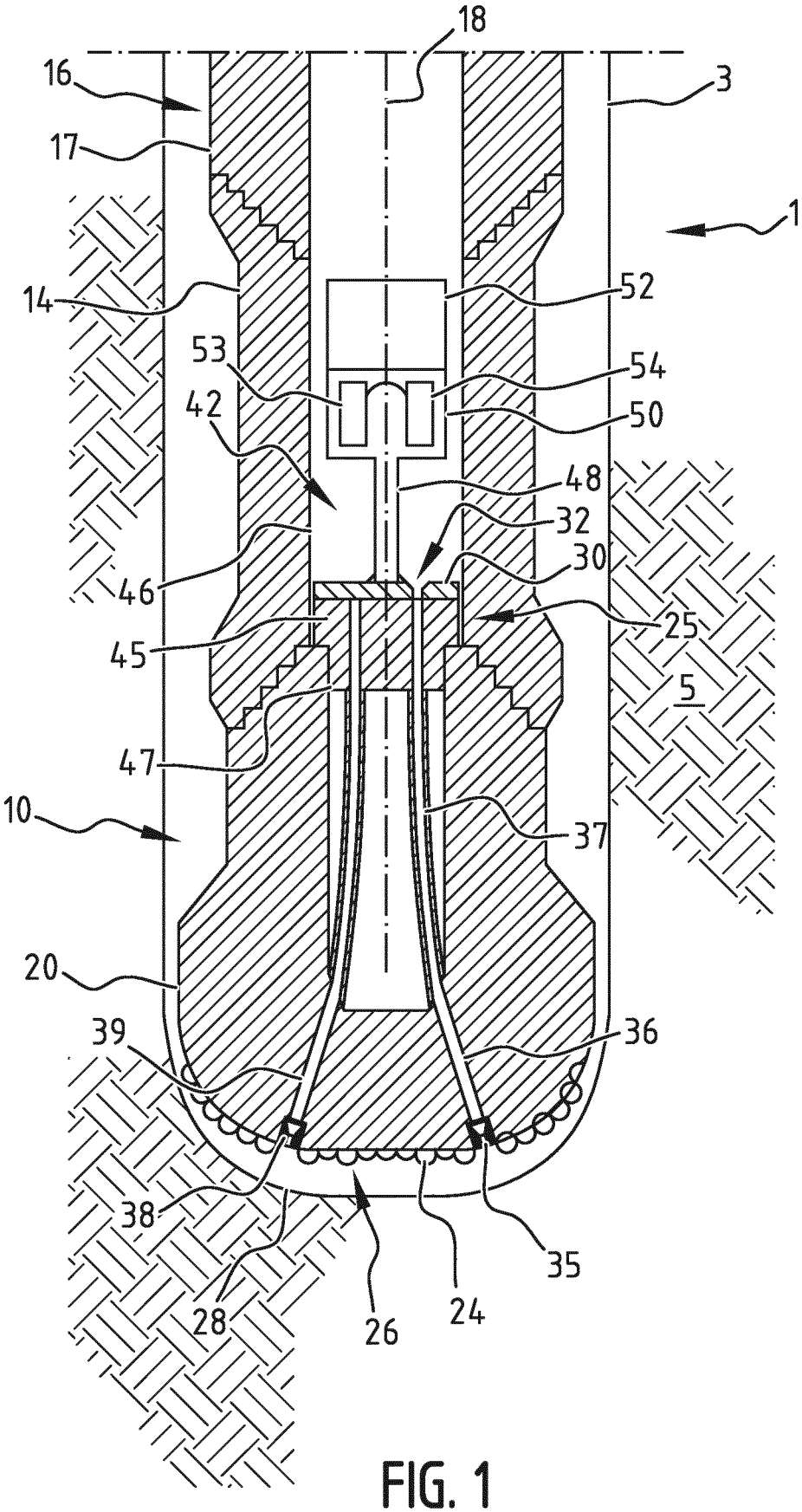
FIG. 1 schematically shows a lower end of a rotary steerable drill string for directional drilling a borehole in an Earth formation.

The invention will be further illustrated hereinafter by way of example only, and with reference to the non-limiting drawing. The person skilled in the art will readily understand that, while the invention is illustrated making reference to one or more specific combinations of features and measures, many of those features and measures are functionally independent from other features and measures such that they can be equally or similarly applied independently in other embodiments or combinations.

It has been discovered that a tool such as for example disclosed in US 2016/0061019 A1, during operation, provides a detectable noise at surface at a frequency that is linearly dependent on the rotational speed of the flow diverter relative to the rotational speed of the drill string. By providing a suitable encoder, the possibility is created to transmit data from a downhole data unit to surface or to a receiver higher-up in the drill string. The downhole data unit is suitably configured to provide an information signal representing the downhole data, and the encoder can be operatively connected to the flow diverter to modulate the relative rotation in accordance with the information signal.

Herewith it is possible to omit a conventional mud-pulser, thereby requiring less equipment downhole. Furthermore, it is possible to transmit the noise signals through a mud motor, in cases where a mud motor is provided in the drill string. Conventionally there is not enough room available below the mud motor to include a conventional mud-pulser in addition to steering equipment. However, in the present case use is made of a fluid diverter, which is primarily implemented below the mud motor to create a lateral force on the drill bit in a preferential direction, for the deviated drilling, to encode mud pulses in order to transmit encoded information signals. The latter can be done during "idle times", i.e. when the fluid diverter is not used to generate the preferential lateral force on the drill bit for deviated drilling, or by switching between generating the preferential lateral force and not in accordance with a modulation pattern which carries the encoded information signal.

It will be understood that the relative rotation is modulated is superimposed on rotation control actions needed to exercise the primary steering duty of the drill string sub. The sole purpose of the additional modulation of the relative rotation is transmitting of information representing the downhole data, which is to be detected and decoded uphole.

The fluid diverter together with the plurality of flow channels form a chopper device, which periodically causes the flow of drilling fluid down the drill string sub to experience different degrees of restriction. This creates chopper noise, originating in fluid pressure waves that are generated by oscillating flow resistance caused in the fluid diverter rotating relative to the flow channels which intermittently align with the eccentric flow port of the flow diverter. This chopper noise is cleverly used to provide a data up-link to communicate data by additional rotation modulations which are not for the purpose of controlling the steering action per se.

It is possible to transmit the modulated chopper noise all the way to surface, or to pick up the noise in intermediate station in the drill string. The intermediate station may comprise a conventional mud-pulser, or other type of telemetry system, which can be employed to relay the information as received from the chopper device. The intermediate station may suitably be an MWD device, in which case the information as received from the fluid diverter may be supplemented with additional information. A supplemented information package may then be sent by the MWD device to the Earth's surface, for instance by mud pulsing in a different frequency range.

While the flow diverter initially causes pressure fluctuations in the drilling fluid, the associated noise propagates as pressure waves through drilling fluid in annuli or drill pipe as, and as acoustic waves through well tubulars (such as drill pipe or casing) or formation rock.

FIG. 1 shows a lower end of a rotary steerable drilling system 1 for directional drilling a borehole 3 in an Earth formation 5, in which the invention may be implemented. The system comprises a drill string sub 14 which, at its drill string end, is connected to a lower end of a drill string 16. The drill bit end of the sub 14, typically the lower end of the sub 14, comprises a drill bit connector 15, with which a drill bit 10 can be connected to the drill string sub 14 in a rotation-locked configuration to rotate in unison with the drill string sub 14 about the drill string longitudinal axis 18. In this example, such drill bit 10 is connected. Even though the drill bit 10 is shown as a fixed cutter drill bit, a roller cone drill bit may be used instead.

The drill string 16 may extend to surface. A relatively heavy drill collar section 17 may optionally be included in the downhole end section of the drill string, and is shown connected to the upper end of drill string sub 14, which is the drill string end. The drill string may be made up of interconnected pipe sections or similar drill string elements.

The longitudinal axis of the drill string sub 14, the drill string 16, as well as drill bit 10, is indicated by dot-dashed line 18. The drill string sub 14 is rotatable about the longitudinal axis 18 at a selected drill string sub rotation frequency. As the drill string sub 14 is in this example rotatably locked to the drill string 16, the selected drill string sub rotation frequency is equal to the drill string rotation frequency. However, in some embodiments a mud motor may be implemented between the drill string 16 and the drill string sub 14, in which case the drill string sub rotation frequency may be different (usually higher) than the drill string rotation frequency. The direction of the rotation is azimuthal. The drill bit 10 is connected to the drill string sub 14 in a rotation-locked configuration. It rotates in unison with the drill string sub 14 about the longitudinal axis 18 at a drill bit rotational frequency within the Earth formation 5 (taking the Earth formation 5 as the frame of reference).

A drilling fluid passage 46 is available within the drill string 16. A drilling fluid may be passed from an upper end of the drill string to the lower end of the drill string 16 via the drilling fluid passage 46. The drilling fluid passage 46 may be defined by a bore within the drill string 16.

In the example shown in FIG. 1, a chopper device 25 is configured in the drill string sub 14, which chopper device 25 comprises a flow diverter 30 and a manifold block 45. The flow diverter 30 is in this example embodiment shown as a disk provided with an eccentric flow port 32. The manifold block 45 is depicted as a disk or a block, provided with a number of manifold channels 47. However, more complicated designs of the flow diverter and/or manifold block, for example consisting of assembled parts, may be employed in practice.

A rotation-controlled platform 42 may be arranged within the drill string sub 14 and capable of imparting relative rotation to the flow diverter 30 in the drill string sub 14. The rotation-controlled platform 42 is indicated very schematically, as the invention described herein is not limited to any specific embodiment of such a rotation-controlled platform. Reference is made to US patent application publication US 2016/0061019 A1, the contents of which are incorporated herein. The reference describes in detail some examples of rotation-controlled platforms, which are used to create a geostationary platform within the drill string. The rotation-controlled platforms of US 2016/0061019 A1 are suitable for use in combination with the present disclosure.

Generally, the rotation-controlled platform 42 is rotatable about the longitudinal axis 18 within the drill string sub 14 and/or the drill string 16 at a platform rotational frequency that differs from the drill string sub or drill string rotational frequency. By controlling the platform rotational frequency relative to the drill string rotational frequency, the rotatable platform 42 can rotate at any desired frequency relative to the Earth formation 5. The rotatable platform 42 will typically comprise a counter-rotator 50 which rotates in a direction opposite to the drill string 16 rotation. The counter-rotator 50 may be coupled to a co-rotor 52 via a variable torque coupling. By regulating the variable torque, the platform rotational frequency can be controlled to any desired value.

The flow diverter 30 may be configured on the rotation-controlled platform 42. For instance, the flow diverter 30 may be rigidly coupled to the counter-rotator 50 by means of for example an output shaft 48. The eccentric flow port 32 in the flow diverter 30 can thus be maintained oriented at a selected azimuth to guide the flow of drilling fluid into a pre-selected azimuthal segment within the drill bit 10.

The rotation-controlled platform 42 is arranged in the drill string sub 14 in such a way that drilling fluid can pass down the interior of the drill string 16 towards the flow diverter 30. The principle of the flow diverter 30, and some embodiments of flow diverters, have been described in US patent publication Nos. 2016/0061019, 2016/0076305, and 2016/0084011, to which reference is made herein.

The rotatable platform 42 may further comprise a downhole data unit 53, which may comprise or be connected to orientation sensors and/or a control unit adapted to obtain orientation data, such as from integrated downhole measurement devices, e.g. MWD devices. From actual and desired orientation data for the outlet member it may be determined, which relative rotation of the rotation-controlled platform 42 with respect to the drill string sub 14 or the drill bit 10 is needed.

The drill bit 10 may comprise a bit body 20 provided with cutter elements 24. A downward-facing base surface of the drill bit forms a bit face 26. During operation, said bit face is positioned near the borehole bottom 28 and facing said borehole bottom 28. Typically, the bit face 26 is in close contact with the borehole bottom 28.

The drill bit 10 is typically provided with a plurality of inlet channels (36,39) to nozzles (35,38), for guiding drilling fluid from the drilling fluid passage 46 to the nozzles, via which the drilling fluid can be expelled into the borehole 3. In FIG. 1, for example, a first nozzle 35 is fed via a first inlet channel 36, and a second nozzle 38 via second inlet channel 39. The first and second nozzles are arranged at different azimuthal positions with respect to the longitudinal axis 18, in this example 180 degrees apart, as counted with respect to rotation of the drill string sub 14 along its longitudinal axis 18.

The flow diverter 30 may be arranged in sliding contact with the manifold block 45 or be separated in longitudinal direction therefrom. The manifold channels 47 are suitably provided in a circular band distributed about the longitudinal axis 18, on a radius that aligns with the eccentricity of the eccentric flow port 32 in the flow diverter 30. This way, upon rotation about the longitudinal axis of the manifold block 45 relative to the flow diverter, the eccentric flow port 32 in the flow diverter 30 repetitively aligns with each of the manifold channels 47 in turn, thereby only passing drilling fluid from the drilling fluid passage 46 to the manifold channel 47 that aligns with the eccentric flow port 32 in the flow diverter 30.

Suitably the number of manifold channels 47 is equal to the number of nozzles in the drill bit 10. Each one of the manifold channels 47 is exclusively connected to one of the inlet channels to the nozzles, and each inlet channel is exclusively connected to one of the manifold channels 47, suitably via a number of intermediate drilling fluid conduits 37. The manifold block 45 is rotationally locked to the drill bit 10 so that it co-rotates with the drill bit 10 and the drill string 16.

In the specific schematic example shown in FIG. 1, in the configuration as shown the first inlet channel 36 to first nozzle 35 will be in fluid communication with the drilling fluid passage 46 while the second inlet channel 39 to the second nozzle 38 will be blocked. When the drill string 16 has rotated by 180 degrees relative to the Earth formation 5, and the flow diverter 30 remains geostationary (not rotating relative to the Earth formation 5), then the second inlet channel 39 to second nozzle 38 will be in fluid communication with the drilling fluid passage 46 while the first inlet channel 36 to the first nozzle 35 will be blocked.

Obviously, if desired three or more nozzles and corresponding manifold channels 47 may be provided at smaller azimuthal intervals (e.g. 120 degrees or 90 degrees). Furthermore, it is conceived that groups of nozzles within an azimuthal segment on the bit face 26 may be connected to a single manifold channel 47 in parallel. In such a case, the bit face 26 could for example comprise two opposing groups of two or more nozzles, or three groups of two or more nozzles.

It will be appreciated that the manifold block 45 and the associated intermediate drilling fluid conduits 37 can be embodied in the form of an insert which can be slid inside a central bore in the drill bit 10. Alternatively, the manifold block 45 and/or the intermediate drilling fluid conduits 37 could be integral to the drill bit 10 (e.g. drilled bores, or channel structures in a cast bit body 20).

For directional drilling, the rotation-controlled platform 42, including the flow diverter 30, may be kept geostationary. The flow diverter 30, specifically the eccentric flow port 32 provided therein, directs the flow of drilling fluid continuously in one azimuthal segment within of the borehole 3, thus creating an underpressure within the borehole 3 and thereby imposing a curve in the trajectory of the borehole 3 towards the segment of underpressure. For drilling in a straight direction, the rotatable platform 42 can be made to either rotate together with the drill string 16 or rotate at any desired non-zero frequency relative to the manifold block 45. In either way, the drilling fluid flow out of the flow diverter 30 sequentially flushes all sides the borehole thereby blurring any preferential deviation of the borehole trajectory.

The system as described in reference to FIG. 1 so far is in essence not much different from the system as described in US patent publication Nos. 2016/0061019, 2016/0076305, and 2016/0084011, with the exception that the system comprises an encoder 54 which is operatively connected to the flow diverter 30 and configured to modulate the relative rotation of the rotation-controlled platform 42 relative to the manifold block 45. The encoder 54 may comprise a downhole computer controller. With the encoder 54, an information signal representing downhole data from the downhole data unit 53 is expressed in a modulation of the relative rotation. Thus, the information from the downhole data unit 53 is transmitted in the form of modulated chopper noise. This may be done when the rotation-controlled platform 42 is not kept geostationary. The modulation may be done faster than the frequency band that is employed to exercise drilling steering control by switching from geostationary mode to not-geostationary mode using a pattern which carries the encoded downhole data.

Figure 2:
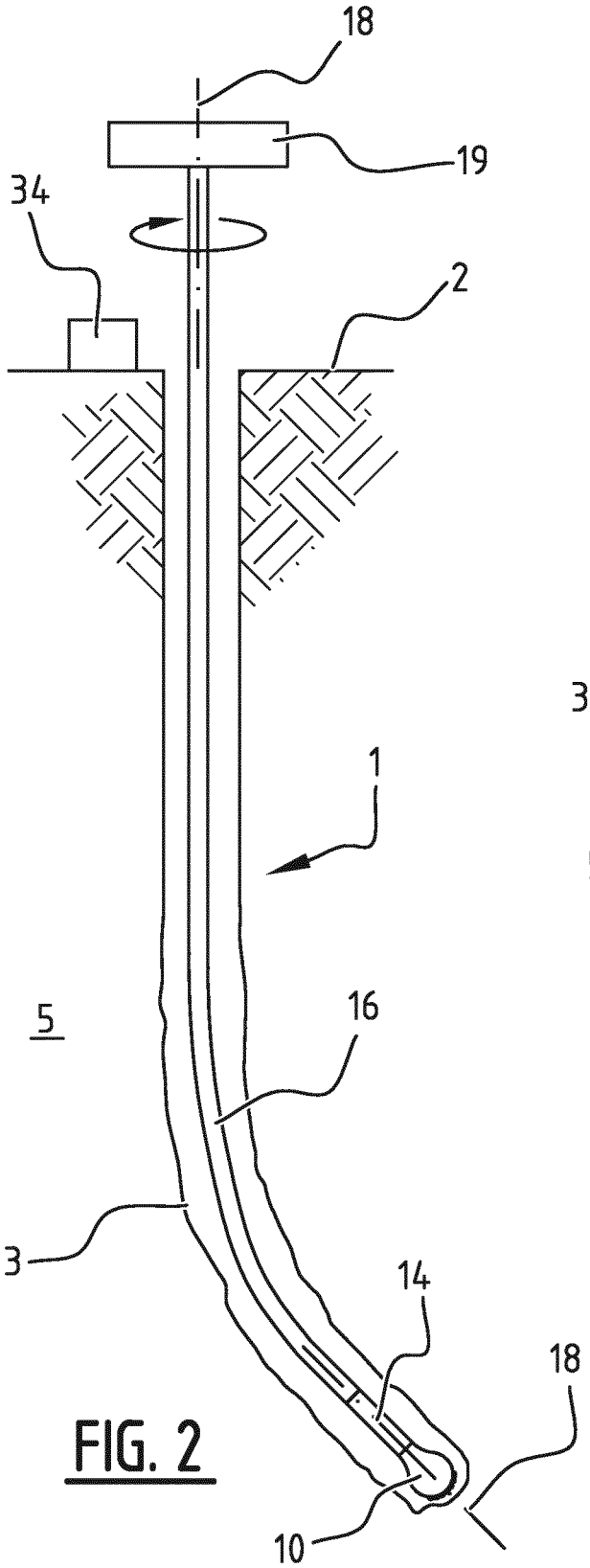
FIG. 2 schematically illustrates a rotary steerable drilling system.

FIG. 2 illustrates how the drill string sub 14 may be implemented in the rotary steerable drilling system 1. The drill string 16 typically extends from above the Earth's surface 2 into the borehole 3 below the surface, whereby a lower end of the drill string is surrounded by the Earth formation 5. The drill string sub 14 is connected to the lower end of the drill string 16. A rotary drive 19, such as a rotary table or a top drive, may be arranged above the Earth's surface and engaging with an upper end of the drill string 16, to impart rotation to the drill string 16 about the longitudinal axis 18. An uphole data unit 34 is provided, to sense and decode rotation modulations (noise modulations) which are caused by fluctuations in drilling fluid pressure by the flow diverter in the drill string sub 14. The uphole data unit 34 may be provided at the surface 2, as shown in FIG. 2, or somewhere downhole along the drill string 16. The term "uphole" in this context is used as a relative term indicating the uphole data unit 34 is generally above the chopper device 25.

Figure 3:
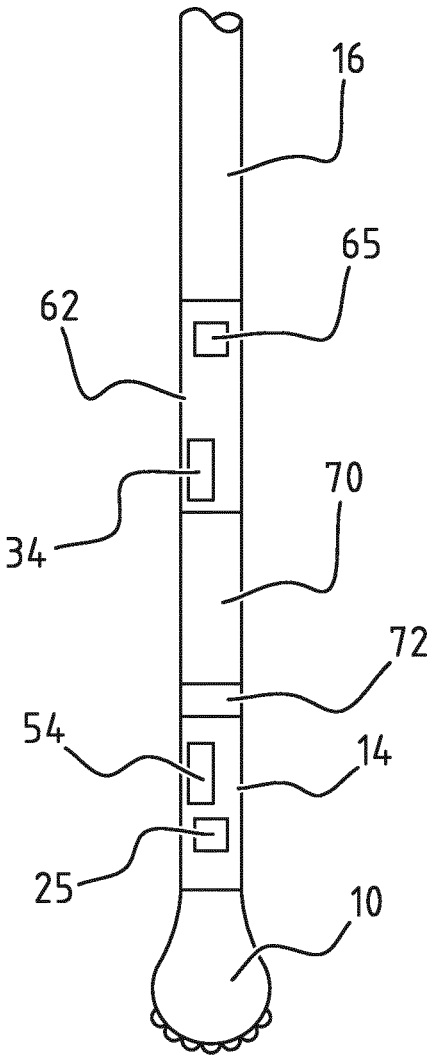
FIG. 3 schematically illustrates a drill string sub connected to a mud motor.

A non-limiting example where it may be useful to provide the uphole data unit downhole, is illustrated in FIG. 3. In this case, an additional MWD sub 62 is provided in the drill string 16 which is provided with the uphole data unit 34, and any suitable type of MWD telemetry unit 65 to receive and transmit data. The MWD sub 62 may receive information as transmitted from the chopper device 25, and relay the information by means of its own MWD telemetry unit 65. The MWD telemetry unit 65 may even be a mud-pulser, suitably operating in a different frequency band or with otherwise different modulation encoding than the chopper device 25. The information transmitted from the MWD telemetry unit 65 may further contain additional information, such as data representing additional measurement sensors that may be provided on the MWD device.

The additional MWD sub 62 may be provided above a mud motor 70. The mud motor 70 may be joined to the drill string sub 14, possibly via an intermediate collar 72, to provide additional cutting power at the drill bit 10. Such intermediate collar 72 which may suitably contain bearings. In this case, information from the drill string sub 14 may be broadcast to the MWD sub 62 across the mud motor 70.

The invention described herein suitably provides a data uplink. The data uplink may be combined with any type of downlink, including conventional downlinking methods. Any suitable modulation technique may be employed, including but not limited to: amplitude modulation (AM); frequency modulation (FM, including frequency-shift keying (FSK); phase modulation; on-off keying (OOK); pulse width modulation (PWM). The encoding/decoding method may employ appropriate fault tolerant communication and modulation strategies, error detecting and correcting methodologies, DC neutral algorithms and/or other known concepts.

Communication protocols may be implemented to facilitate co-existence of multiple uses of the same physical communication channel (mud pressure waves/pulses, and chopping noise for steering). In a preferred embodiment, the communication may be initiated by a command from surface to a receiver in a BHA, which, if properly received, then opens a time window for the BHA to respond using the method described hereinabove, for a specific duration of time as may be commanded from surface. After that time has lapsed, the generation of noise may cease by letting the flow diverter rotate at the same speed as the drill bit rotates. The thus created silence on the physical channel enables new commands from surface to be issued at any time deemed appropriate by a controller at surface.

Suitable strategies could for example allow a M minutes steering (+data transmission) period, during which for example N data bits of T seconds per bit are encoded by the flow diverter chopper. M, N and T can be defined at surface and be part of a downlinking message. Typical values are 1-20 minutes for M, N is say 50-1000 databits per message, and bit times could be 1 to 10 seconds.

Suitable message encoding includes for example a preamble for bit synchronization, followed by a 'golden key' for byte synchronisation, the actual payload and a cyclic redundancy check of for example 16 bits, followed by a trailer of arbitrary length, as much as needed to meet the M period when M is longer than N*T.

Likewise, protocols that only do the short hop over a mud motor to an intermediate station, but must co-exist with e.g. mud pulse links to surface, can similarly be defined.

The person skilled in the art will understand that the teachings described in the present paper can be applied to advantageously modify any of the embodiments described in US patent publication Nos. 2016/0061019, 2016/0076305, and 2016/0084011; all of which are incorporated herein by reference.

The person skilled in the art will understand that the present invention can be carried out in many various ways without departing from the scope of the appended claims.

That which is claimed is:

1. A method of operating a rotary steerable drilling system comprising a drill string sub comprising a drill string end connectable to a drill string, and a drill bit end opposing the drill string end in a longitudinal direction, and said drill string sub being rotatable in an azimuthal direction about a drill string longitudinal axis:

a drilling fluid passage within the drill string sub, to support a flow of drilling fluid from the drill string end to the drill bit end via the drilling fluid passage;

a flow diverter configured in the drilling fluid passage, which flow diverter is configured rotatable about the drill string longitudinal axis relative to the drill string sub, to preferentially direct the drilling fluid from the drilling fluid passage into a selected azimuth segment which is stationary relative to the flow diverter;

a plurality of flow channels which are rotationally locked to the drill string sub and intermittently align with an eccentric flow port of the flow diverter upon rotation of flow diverter relative to the plurality of flow channels, said method comprising:

rotating the drill string sub in a drill string rotation direction about the drill string longitudinal axis, within an Earth formation, and at a drill string rotation frequency, wherein alternatingly:

rotating the flow diverter in a geostationary mode, wherein keeping the flow diverter in a geostationary orientation whereby the flow diverter rotates at a relative rotation frequency, relative to the plurality of flow channels, which is oppositely directed to the drill string rotation direction and equal to the drill string rotation frequency; and rotating the flow diverter in an encoding mode whereby modulating the relative rotation frequency in accordance with an information signal with the purpose of transmitting information representing downhole data to be detected uphole.

2. The method of claim 1, further comprising at a location above the flow diverter, sensing frequency modulations which are caused by fluctuations in drilling fluid pressure by the flow diverter;

decoding the frequency modulations.

3. The method of claim 2, wherein the flow diverter is rotated below a mud motor and the location above the flow diverter to which the information is transmitted is above the mud motor.

4. The method of claim 2, further comprising an uphole data unit configured for performing said sensing and decoding of said frequency modulations.

5. The method of claim 1, wherein the information signal representing downhole data is provided from a downhole data unit configured in the drill string sub.

6. The method of claim 1, wherein said relative rotation frequency is modulated by an encoder, said encoder is configured to be located in the drill string sub and operatively connected to the flow diverter for said transmitting of the information representing the downhole data to be detected uphole.

7. The method of claim 6, wherein the flow diverter is rotatably locked to a rotation-controlled platform, wherein said rotation-controlled platform comprises the encoder.

8. The method of claim 1, wherein the plurality of flow channels is provided in a manifold block which is configured rotationally locked relative to the drill string sub.

9. The method of claim 8, wherein the manifold block is arranged in sliding contact with the flow diverter.

10. The method of claim 1, wherein the drill bit end comprises a drill bit which is connected to the drill string sub in a rotation-locked configuration to rotate in unison with the drill string sub about the drill string longitudinal axis.

11. The method of claim 1, further comprising imparting rotation to the drill string about the drill string longitudinal axis using a rotary drive arranged above the Earth's surface and engaged with an upper end of said drill string.

* * * * *